US011530896B2

(12) United States Patent
Kusilek

(10) Patent No.: US 11,530,896 B2
(45) Date of Patent: Dec. 20, 2022

(54) FIREARM WITH INTEGRATED LEVELERS

(71) Applicant: Wesley Ray Kusilek, River Falls, WI (US)

(72) Inventor: Wesley Ray Kusilek, River Falls, WI (US)

( * ) Notice: Subject to any disclaimer, the term of this patent is extended or adjusted under 35 U.S.C. 154(b) by 0 days.

(21) Appl. No.: 17/517,246

(22) Filed: Nov. 2, 2021

(65) Prior Publication Data

US 2022/0299294 A1 Sep. 22, 2022

Related U.S. Application Data

(60) Provisional application No. 63/164,156, filed on Mar. 22, 2021.

(51) Int. Cl.

| | |
|---|---|
| ***F41C 27/22*** | (2006.01) |
| ***F41C 23/22*** | (2006.01) |
| ***F41A 23/10*** | (2006.01) |
| ***F41A 23/04*** | (2006.01) |

(52) U.S. Cl.
CPC ..... *F41C 27/22* (2013.01); *F41A 23/04* (2013.01); *F41A 23/10* (2013.01); *F41C 23/22* (2013.01)

(58) Field of Classification Search
CPC ..... F41C 27/22; F41C 23/22; F41A 23/04; F41A 23/06; F41A 23/08; F41A 23/10
See application file for complete search history.

(56) References Cited

U.S. PATENT DOCUMENTS

| | | | | | |
|---|---|---|---|---|---|
| 2,472,804 | A * | 6/1949 | Bird | F41F 3/0455 | 89/1.7 |
| 4,776,124 | A * | 10/1988 | Clifton | F41A 23/08 | 42/94 |
| 5,937,560 | A * | 8/1999 | Beltz | F41A 23/06 | 42/94 |
| 6,305,116 | B1 * | 10/2001 | Parker | F41A 23/04 | 89/37.04 |
| 6,637,708 | B1 * | 10/2003 | Peterson | A01M 31/02 | 182/187 |
| 6,772,549 | B2 | 8/2004 | Muhlestein | | |
| 7,124,528 | B2 | 10/2006 | Long | | |
| 7,610,711 | B2 * | 11/2009 | Oz | F41C 23/20 | 42/94 |
| 7,954,271 | B1 * | 6/2011 | Bentley | F41C 23/16 | 42/72 |
| 8,156,676 | B1 * | 4/2012 | Moody | F41A 23/06 | 42/71.01 |
| 8,276,306 | B2 | 10/2012 | Lickteig | | |

(Continued)

FOREIGN PATENT DOCUMENTS

| | | | | |
|---|---|---|---|---|
| AT | 505414 | A4 * | 1/2009 | F41A 23/06 |
| AU | 2010321667 | A1 * | 7/2012 | F16F 9/0218 |
| EP | 3193129 | A1 * | 7/2017 | F16G 11/10 |

*Primary Examiner* — Benjamin P Lee
(74) *Attorney, Agent, or Firm* — Dale J. Ream

(57) ABSTRACT

A firearm having a butt stock portion and a front stock portion includes a monopod assembly movable in a first linear movement between a stowed configuration inside said butt stock and a deployed position substantially outside said butt stock portion and a second rotational movement designed to refine a length adjustment. The firearm includes a bipod assembly pivotally movable between a storage configuration adjacent and in-line with the front stock portion and a use or spayed configuration supporting the firearm framework.

11 Claims, 12 Drawing Sheets

(56) References Cited

U.S. PATENT DOCUMENTS

| | | | | |
|---|---|---|---|---|
| 8,826,580 | B2 | 9/2014 | Lewis | |
| 9,121,665 | B2 * | 9/2015 | Hinds | F41C 27/22 |
| 9,618,292 | B1 * | 4/2017 | Hancosky | F16M 11/041 |
| 9,874,419 | B1 * | 1/2018 | Beck | F41C 23/20 |
| 10,323,897 | B1 * | 6/2019 | Ding | F41A 23/06 |
| 2002/0050088 | A1 * | 5/2002 | Sharp | F41C 23/04 42/73 |
| 2007/0011932 | A1 * | 1/2007 | Oz | F41A 23/06 42/94 |
| 2011/0247256 | A1 * | 10/2011 | Lickteig | F41A 23/16 42/94 |
| 2012/0285068 | A1 * | 11/2012 | Lewis | F41C 27/22 42/94 |
| 2013/0174463 | A1 * | 7/2013 | Hinds | F41C 27/22 42/94 |
| 2014/0190059 | A1 * | 7/2014 | Ballard | F41A 23/08 42/94 |
| 2018/0202746 | A1 * | 7/2018 | Flood, Jr. | F41A 23/10 |
| 2019/0041156 | A1 * | 2/2019 | Beachli | F41A 23/10 |
| 2019/0154394 | A1 * | 5/2019 | Eccleshall | F41A 23/08 |
| 2021/0278161 | A1 * | 9/2021 | Gearing | F41A 23/08 |

* cited by examiner

FIREARM WITH INTEGRATED LEVELERS

REFERENCE TO RELATED APPLICATIONS

This application claims the benefit of Provisional patent application U.S. 63/164,156 filed Mar. 22, 2021 titled Firearm with Integrated Levelers, which is incorporated herein in its entirety.

BACKGROUND OF THE INVENTION

This invention relates generally to firearms and, more particularly, to a firearm having monopod and bipod stabilizing devices integrated into the framework of the firearm for fast deployment and use in aiming the firearm with accuracy.

The use of portable tripods and bipods that may be attached to a gunstock have been proposed to improve the accuracy of shooting equipment. Optimizing the accuracy of a long barrel rifle is important for many reasons, including target practice, shooting competitions, sniper applications in the military, or the like. Although presumably effective for their intended purposes, the existing devices and proposals still need to be improved and, in particular, need to be integrated into the firearm itself.

Therefore, it would be desirable to have a firearm with integrated front and rear leveling assemblies so that a shooter can quickly deploy the leveling assemblies to stabilize the firearm for aiming and then shooting. Further, it would be desirable to have a firearm that includes a rearward leveling assembly that is, at first, spring-loaded to extend from inside the butt stock of the firearm and then, second, is threadably length adjustable. In addition, it would be desirable to have a firearm that includes a frontward leveling assembly having a bipod assembly that quickly folds down for use in stabilizing the firearm.

DESCRIPTION OF THE PREFERRED EMBODIMENT

Figure 1A:
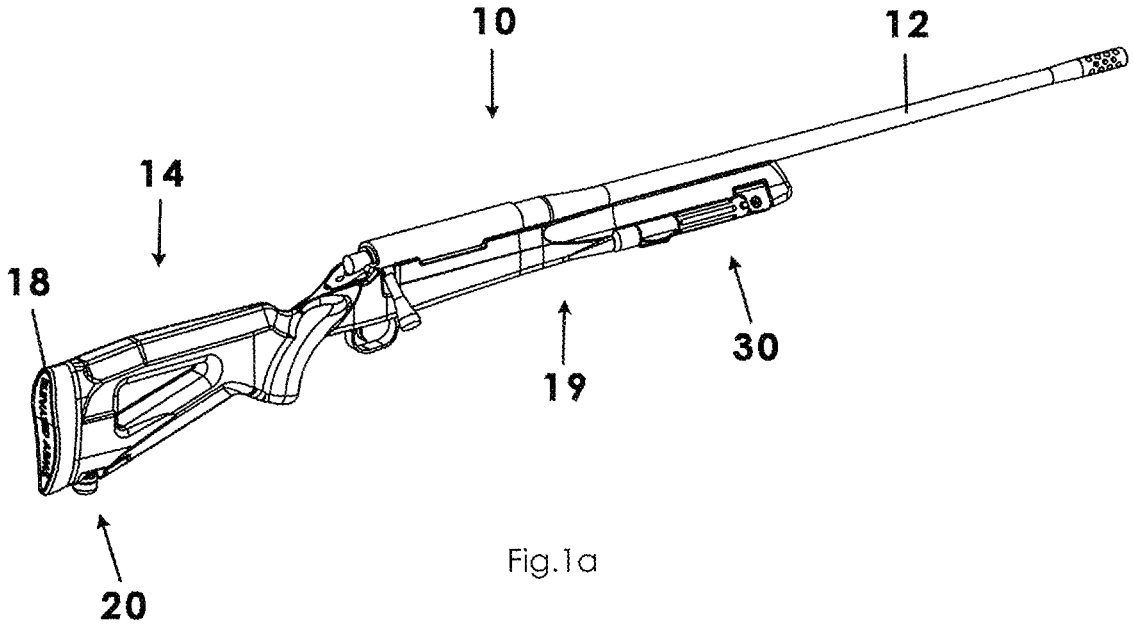
FIG. 1*a* is a perspective view of a firearm with integrated leveling assemblies according to a preferred embodiment of the present invention, illustrated with both leveling assemblies in stowed or retracted configurations.

A long barrel firearm having forward and rearward leveling assemblies according to a preferred embodiment of the present invention will now be described with reference to FIG. 1*a* to 9*b* of the accompanying drawings. The long barrel firearm 10 includes a rifle framework having a butt stock portion 14 (i.e., the rear end that is placed against a shooter's shoulder) and a front stock portion 19 adjacent or coupled to the barrel 12 of the firearm (i.e., the barrel end of the firearm. The butt stock portion 14, therefore, is displaced from the front stock portion 19. Further, the firearm 10 includes a monopod assembly 20 (also referred to interchangeably as a rearward leveling assembly 20) integrated into the butt stock portion 14 and selectively actuated to deploy from the butt stock 14 so as to serve as a rearward leveling assembly 20. Still further, the firearm includes a bipod assembly 30 (also referred to as a frontward leveling assembly 30) having a pair of legs 31 pivotally coupled to the front stock portion 19 and pivotally movable between storage and use configurations so as to serve as a frontward leveling assembly 30.

Figure 3A:
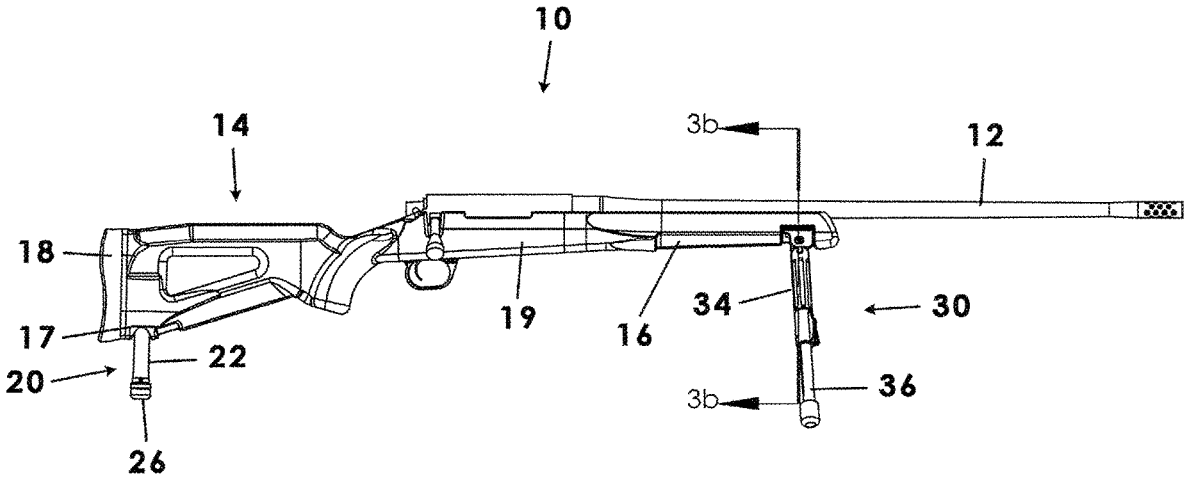
FIG. 3*a* is a side view of the firearm as in FIG. 1*b;*
Figure 3B:
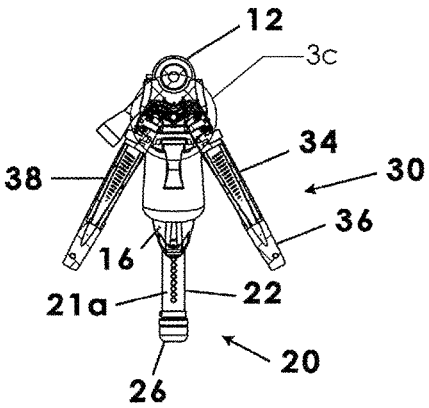
FIG. 3*b* is a sectional view taken along line 3*b*-3*b* of FIG. 3*a;*
Figure 3C:
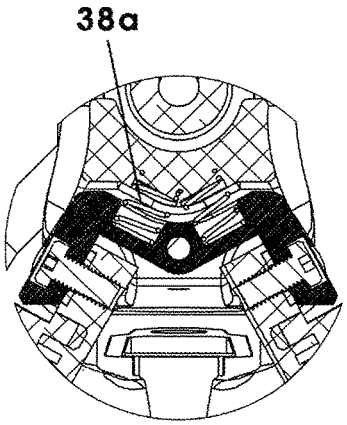
FIG. 3*c* is an isolated view on an enlarged scale take him n from FIG. 3*a;*
Figure 4:
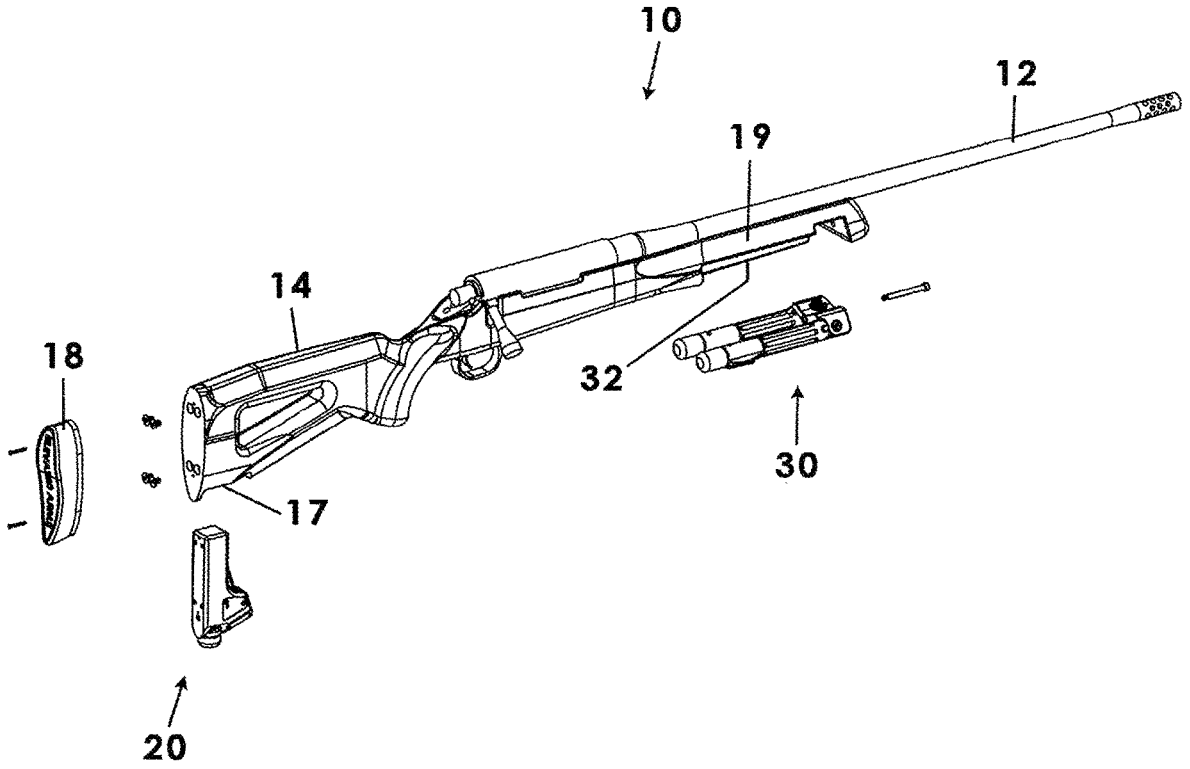
FIG. 4 is an exploded view of the firearm as in FIG. 1*a;*

The butt stock portion 14 of the firearm includes a rear edge to which a shoulder pad 18 may be attached and which represents the part of the rifle that is typically held against the shooter's shoulder when firing. In an embodiment, the butt stock portion 14 defines a hollow interior space and, more specifically, an upstanding channel 16 adjacent the rear edge that is in communication with a deployment aperture 17. In other words, the channel 16 is situated in an up/down orientation such that deployment of the monopod assembly is downwardly through a bottom of the butt stock portion 14 and perpendicular to a longitudinal axis of the barrel 12 of the firearm 10 (FIG. 3).

Figure 7A:
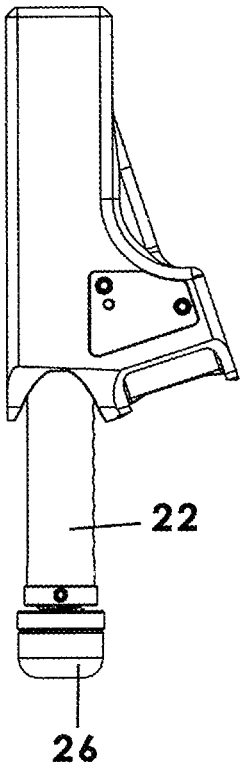
FIG. 7*a* is a side view of a monopod housing according to FIG. 1*b* of the present invention.
Figure 7B:
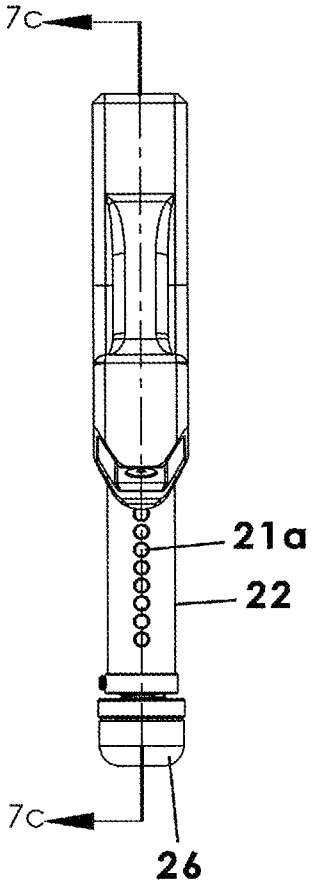
FIG. 7*b* is an end view of the monopod housing as in FIG. 7*a;*
Figure 7C:
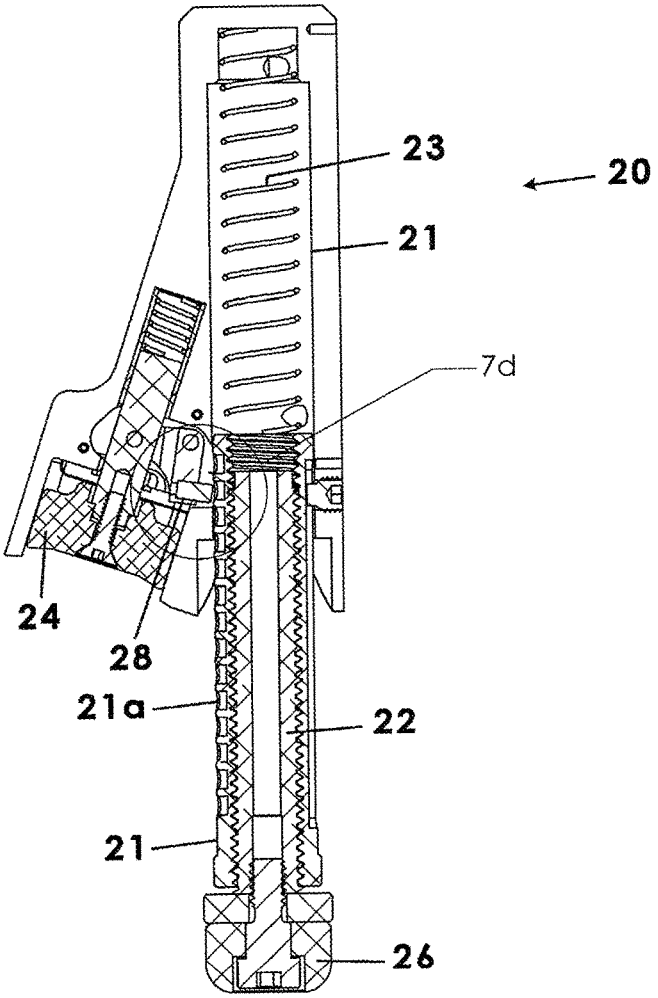
FIG. 7*c* is a sectional view taken along line 7*c*-7*c* of FIG. 7*b;*
Figure 7D:
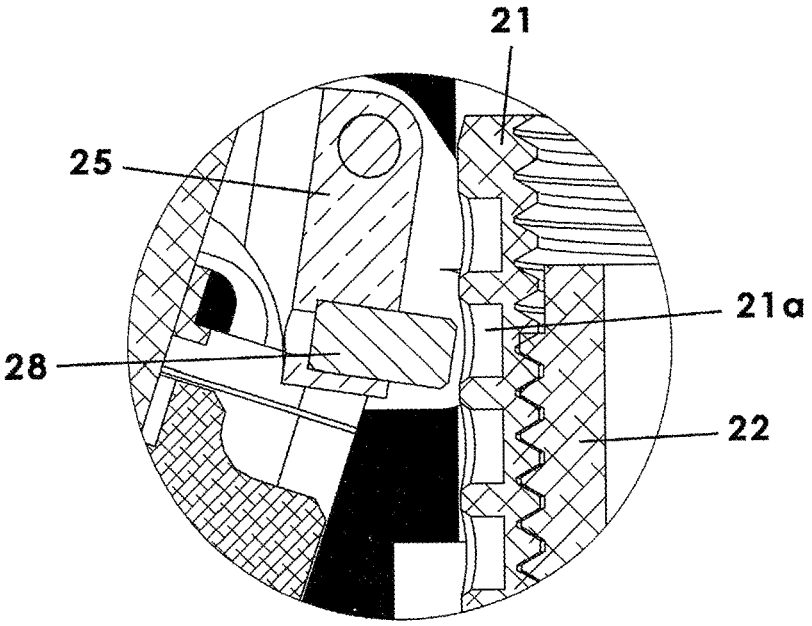
FIG. 7*d* is an isolated view on an enlarged scale taken from FIG. 7*c;*
Figure 8A:
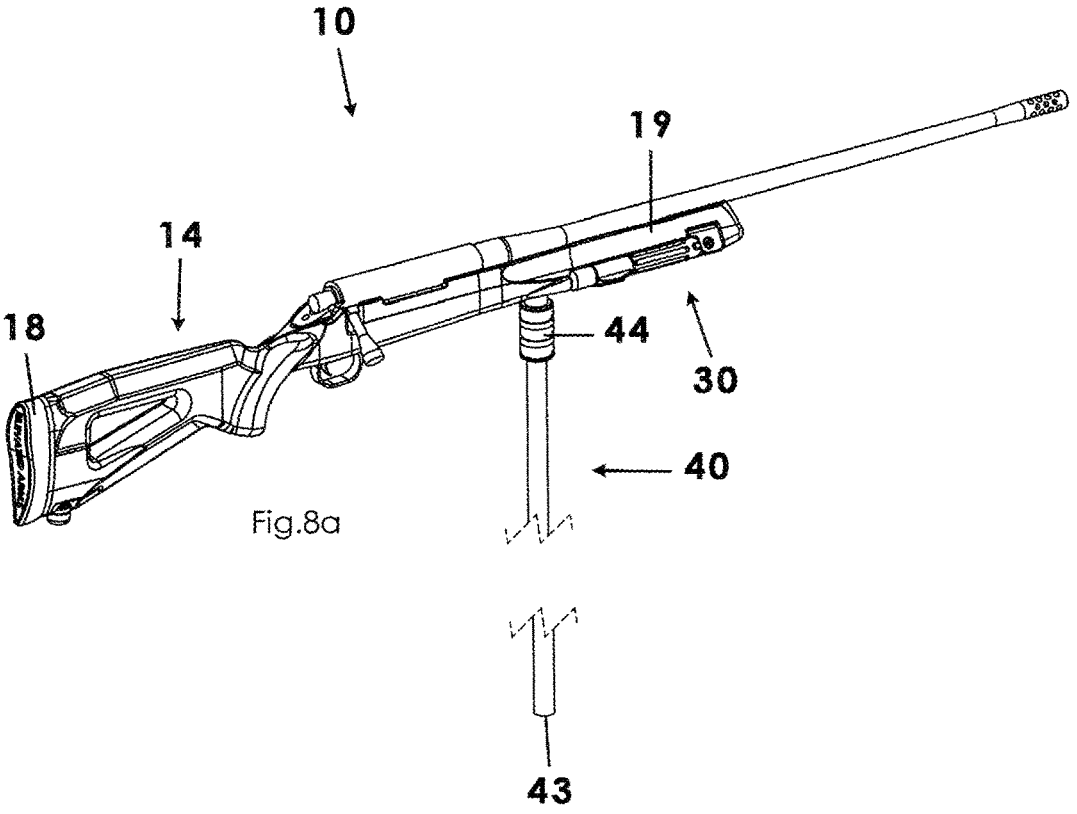
FIG. 8*a* is a perspective view. of a firearm with integrated leveling assemblies according to another embodiment of the present invention, illustrated with a support stick in a coupled configuration.
Figure 8B:
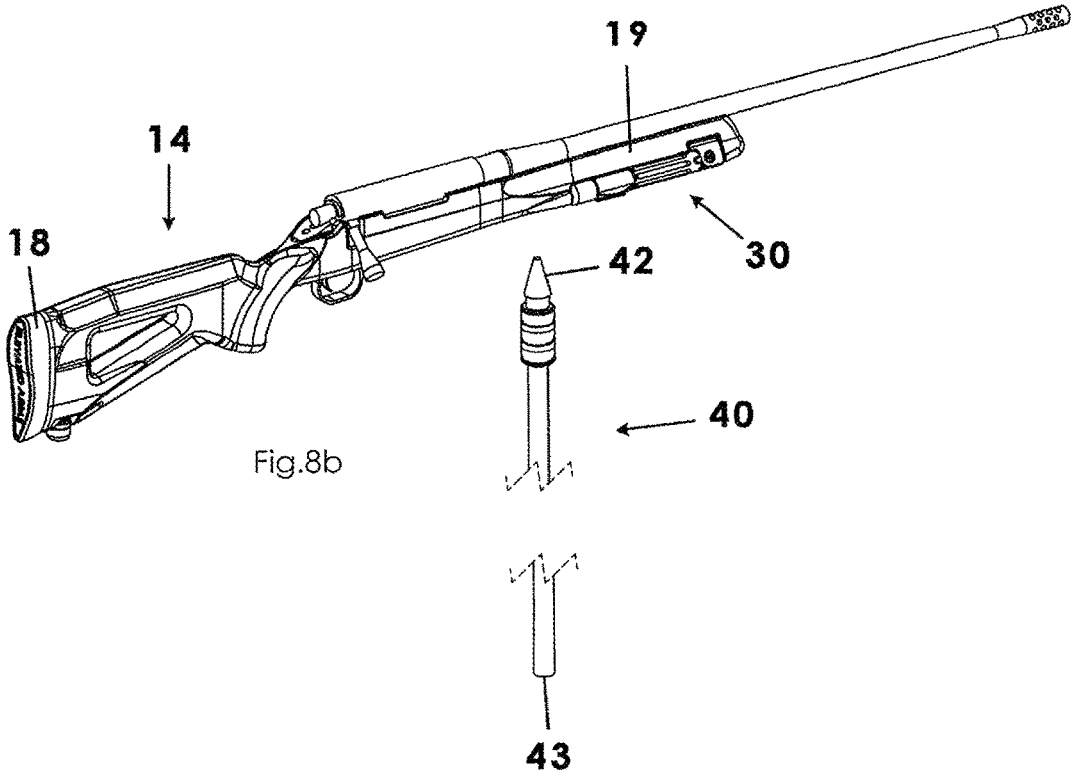
FIG. 8*b* is a perspective view of the firearm as in FIG. 8*a*, illustrated with the support stick in a released configuration.
Figure 9A:
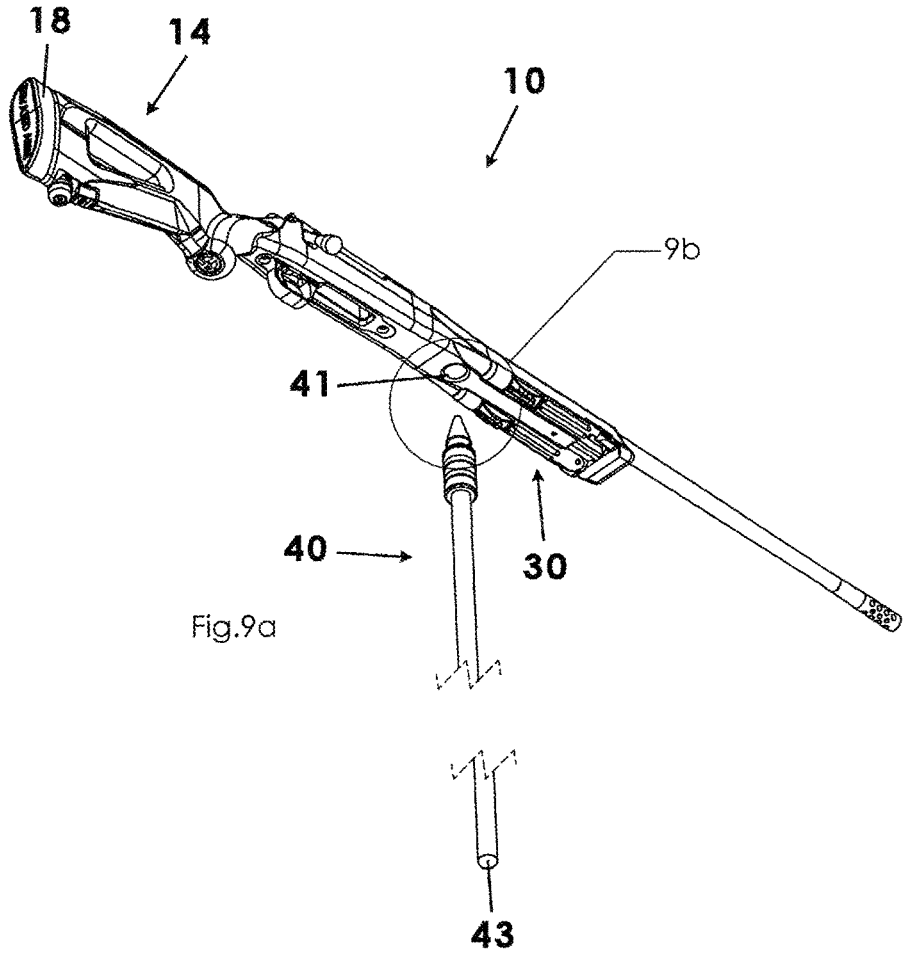
FIG. 9*a* is a perspective view from a lower angle of the firearm as in FIG. 8*b*.
Figure 9B:
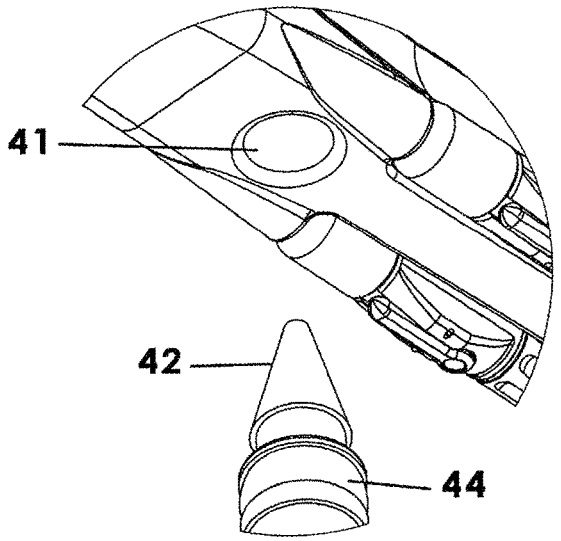
FIG. 9*b* is an isolated view on an enlarged scale taken from FIG. 9*a*.

The rearward leveling assembly 20 may also be referred to as a monopod assembly 20 (use of the same numeral 20 is intentional) although the monopod assembly itself may have multiple portions or components as will be described below. In an embodiment, the monopod assembly 20 is coupled to an inner surface of the butt stock portion 14. In an embodiment, the monopod assembly may include a housing 29 defining its own channel for receiving the monopod portions (described below) and the housing 29 being inserted into the channel 16. is slidably movable between a stowed configuration substantially inside the channel (FIG. 6*a*) and a deployed configuration substantially outside of the channel 16 (FIG. 7*a*).

Figure 1B:
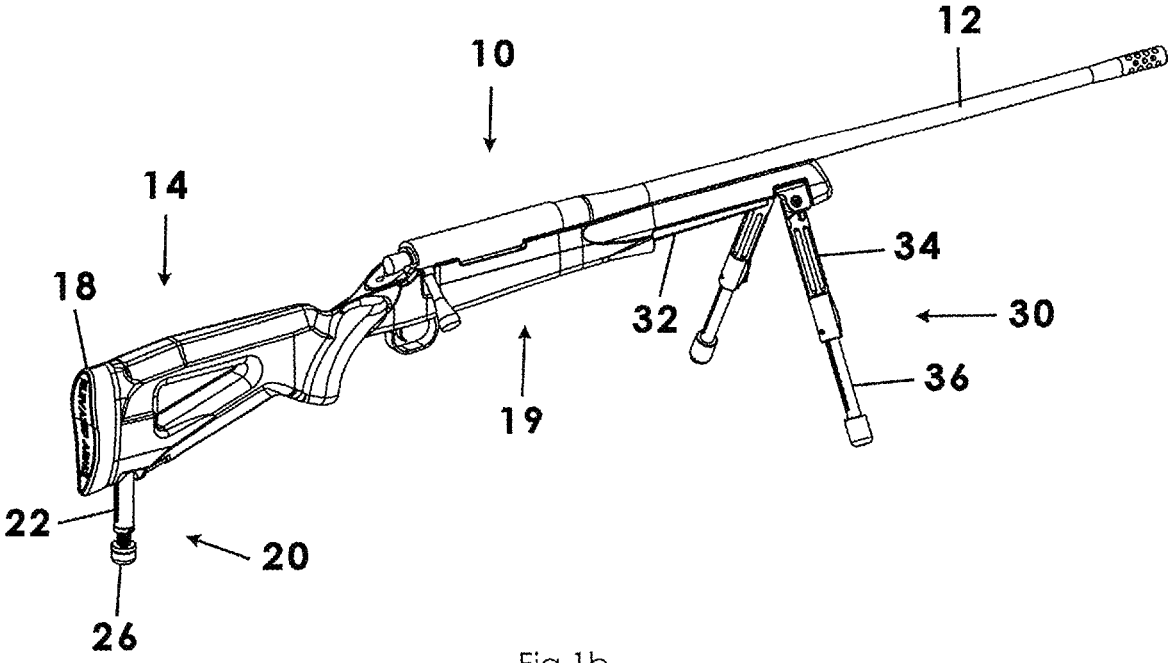
FIG. 1*b* is a perspective view of the firearm as in FIG. 1*a*, illustrated with both leveling assemblies in extended or deployed configurations.
Figure 2A:
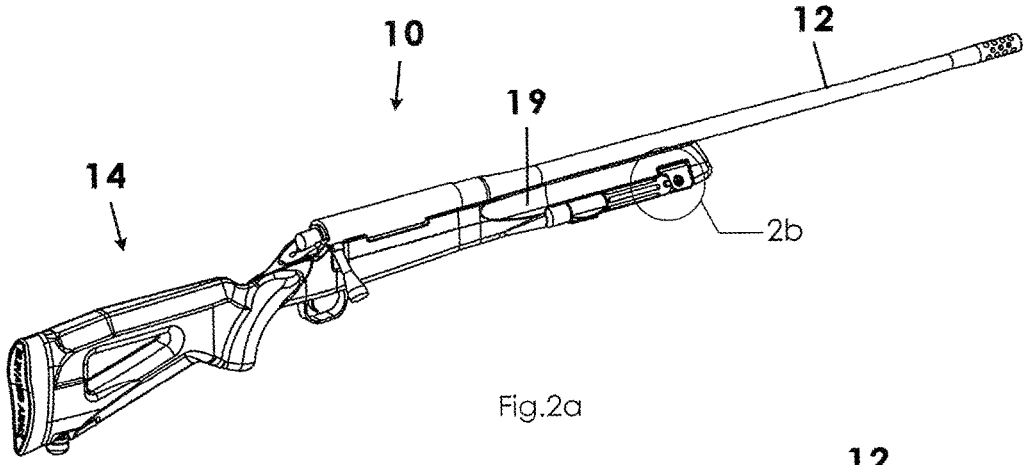
FIG. 2*a* is another perspective view of the firearm as in FIG. 1*a;*
Figure 2C:
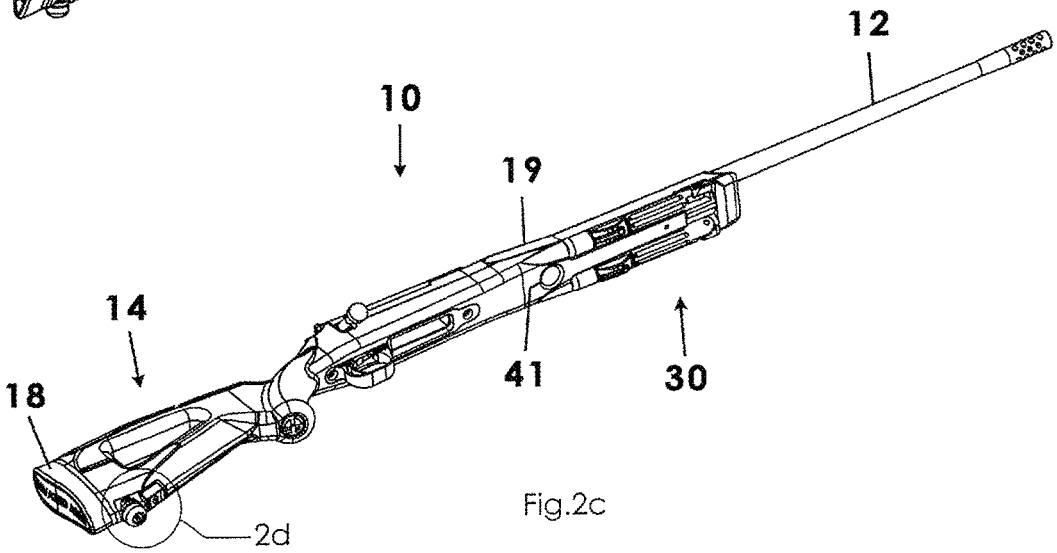
FIG. 2*c* is a bottom perspective view of the firearm as in FIG. 2*a;*
Figure 2B:
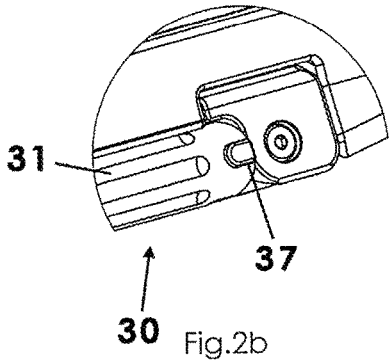
FIG. 2*b* is an isolated view on an enlarged scale taken from FIG. 2*a;*
Figure 2D:
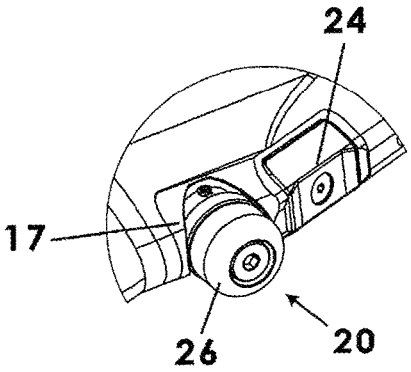
FIG. 2*d* is an isolated view on an enlarged scale taken from FIG. 2*a;*

More particularly, the monopod assembly 20 includes an extension spring 23 (also referred to as a compression spring) positioned in the channel and coupled to the monopod assembly for urging the monopod assembly from a stowed configuration to a deployed configuration when actuated. The monopod assembly 20 may include spring activation button 24 operably coupled to the spring 23 for selectively actuating the spring 23, i.e., allowing the spring 23 to extend (decompress) and push the monopod outwardly through the deployment aperture 17. As will be described below, actuation of spring 23 will almost instantaneously push the inner and outer portions of the monopod assembly 20 downwardly to the deployed configuration shown in FIGS. 7*a* and 7*b*. Stated another way, the monopod assembly 20 may include a first portion 21 (an outer tube) fixedly attached to the spring 23 and defining an inner chamber and a second portion 22 (an inner tube) coupled to the first portion 21 (FIGS. 6*c* and 7*c*) and slidably and longitudinally movable, when actuated, between a retracted configuration substantially inside the chamber and an extended configuration incrementally outside the chamber and extending away from said first portion 21 (FIGS. 1*a* and 1*b*). This may be referred to as the "first instance" or "first action" of movement of the monopod assembly.

In a second instance or second action of movement, the first and second portions 21, 22 of the monopod assembly 20 may be incrementally length adjustable via a rotational action. More particularly, the first portion 21 has a tubular and threaded configuration defining an interior space and the second portion 22 is rotatably movable relative to the first portion 21 between a shortened or retracted configuration substantially positioned and an extended configuration extending away from the interior space. In other words, the first portion 21 and second portion 22 have a threaded structure that enables selective rotational length adjustment. Further, the first portion 21 may define a plurality of extension position holes 21*a* and a linkage to an activation button 24 may include an extension locking pin 28 that is configured to selectively engage a selected extension position hole 21*a*, respectively. In an embodiment, the linkage may include an extension release rocker 25 that is pivotally biased by the compression spring 23 associated with the activation button 24 relative to the extension locking pin 28 for regulating engagement of said pin 28 and a selected hole 21*a* and so as to stop further rotational length adjustment of the first and second leg portions 21, 22.

In a related aspect, the first portion 21 may include an anti-rotation fastener 28*a* that may be actuated (i.e., screwed in) so as to bear against the second portion 22 and stop rotation altogether (such as when a shooter has found his ideal rotational length adjustment). A base pad 26 may be coupled to a free end of the second portion 22 for gripping a ground surface when deployed.

In another aspect, the frontward leveling assembly 30 may be pivotally coupled to the front stock portion 19 of the firearm 10. More particularly, the front stock portion 19 defines a pair of storage channels each having an open bottom into which the frontward leveling assembly 30 may be attached. In an embodiment, the frontward leveling assembly 30 includes a pair of legs 31 each being length adjustable and being pivotally movable between a storage configuration nested in the pair of storage channels and a use configuration pivotally extending away from the pair of storage channels and splayed generally perpendicular to the front stock portion 19 of the long barrel firearm 10. More particularly, each of the pair of legs 31 may be pivotally coupled to a center pivot member so as to rotate downwardly and outwardly by operation of a pair of centering springs 38 when released and actuated as described in more detail below. Each leg, therefore, may be spring-loaded (via extension springs 38) and includes an actuation mechanism 37 for selectively releasing the distal portion 36 to deploy to the use configuration shown in FIG. 1*b*. Thus, the first action for deploying the pair of legs of the frontward leveling assembly 30 is by actuation/release of the compression springs 38*a*.

Figure 5A:
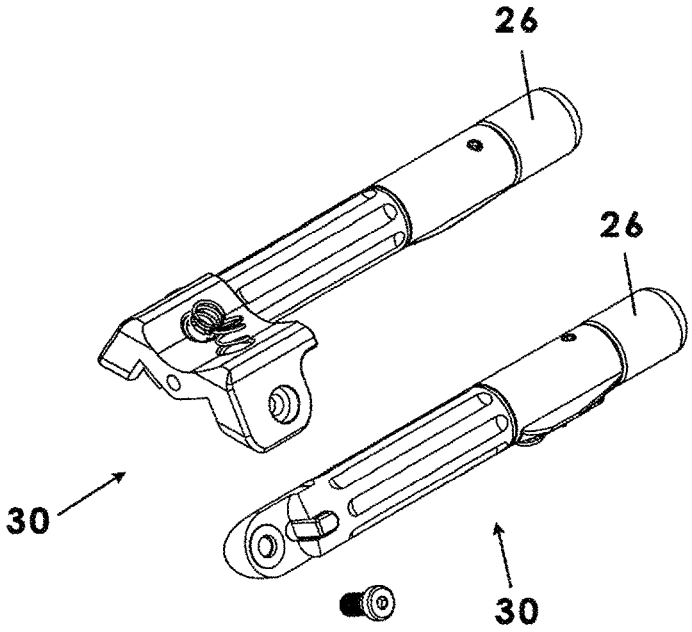
FIG. 5*a* is an isolated view of a pair of legs of a bipod assembly according to the present invention.
Figure 5B:
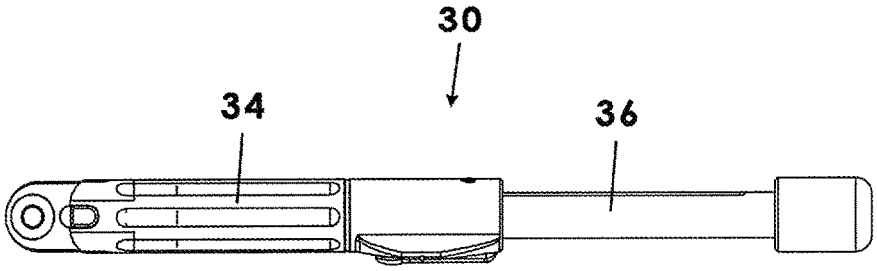
FIG. 5*b* is a side view of a respective leg of the bipod assembly as in FIG. 5*a;*
Figure 5C:
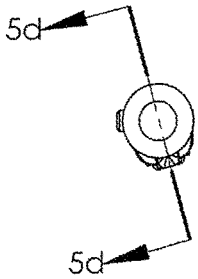
FIG. 5*c* is an end view of the leg as in FIG. 5*b;*
Figure 5D:
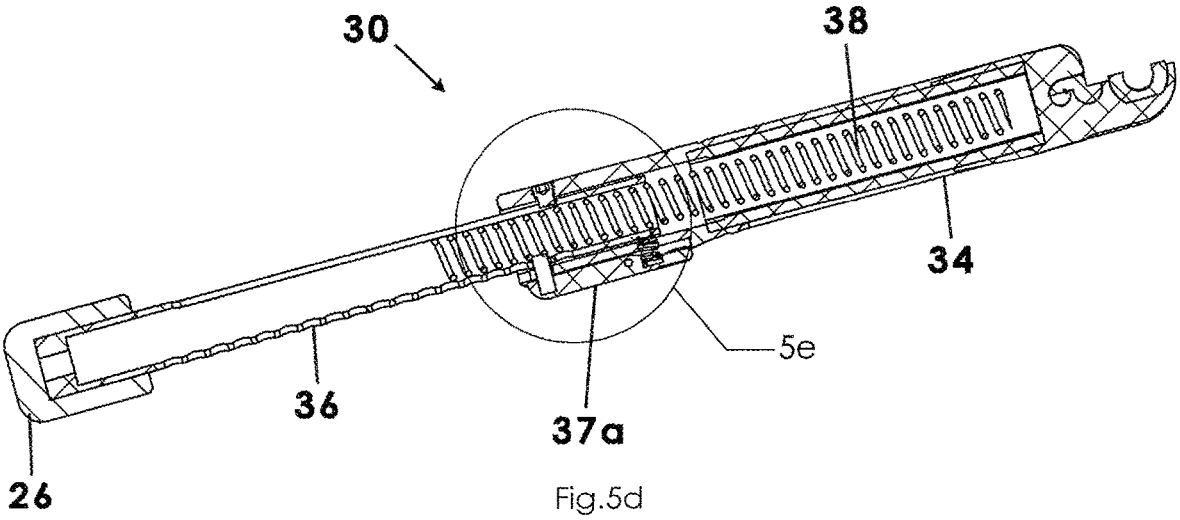
FIG. 5*d* is a sectional view taken along line 5*d*-5*d* of FIG. 5*c;*
Figure 5E:
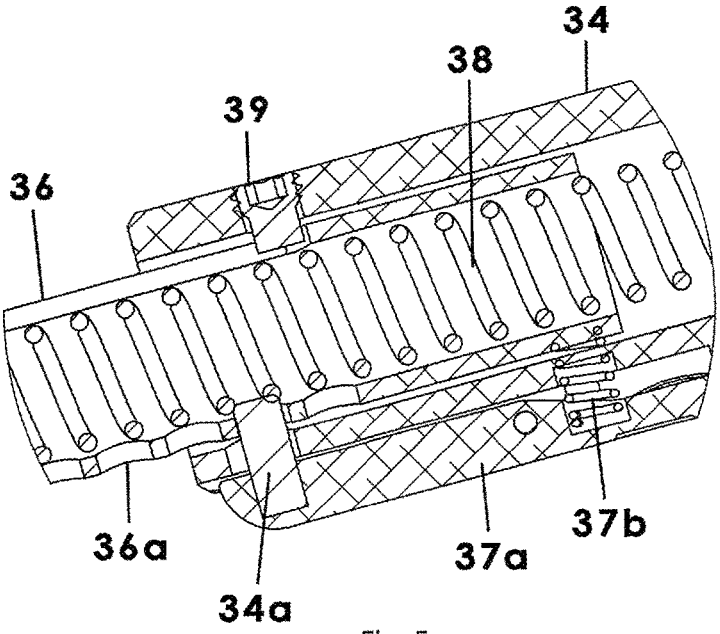
FIG. 5*e* is an isolated view on an enlarged scale taken from FIG. 5*d;*
Figure 6A:
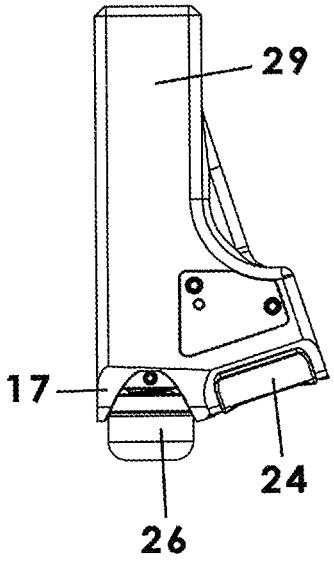
FIG. 6*a* is a side view of a monopod housing according to FIG. 1*a* of the present invention.
Figure 6B:
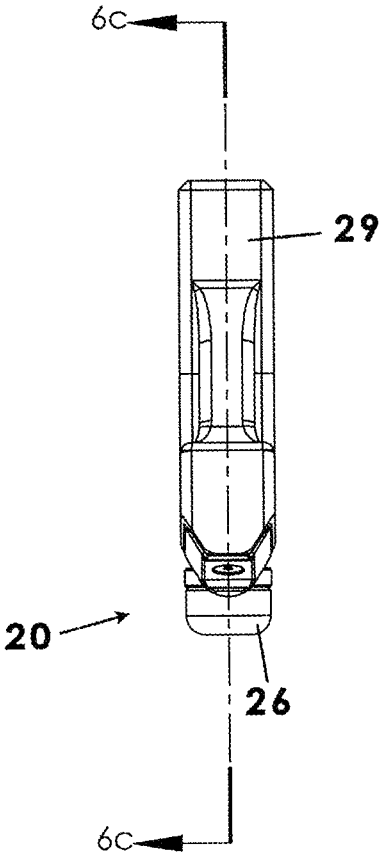
FIG. 6*b* is an end view of the monopod housing as in FIG. 6*a;*
Figure 6C:
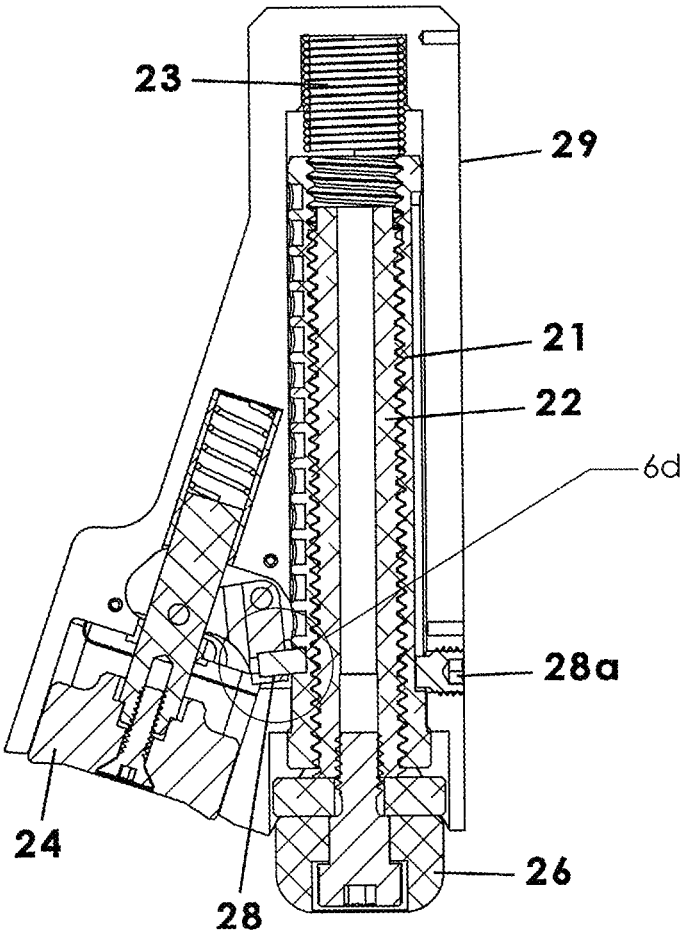
FIG. 6*c* is a sectional view taken along line 6*c*-6*c* of FIG. 6*b;*
Figure 6D:
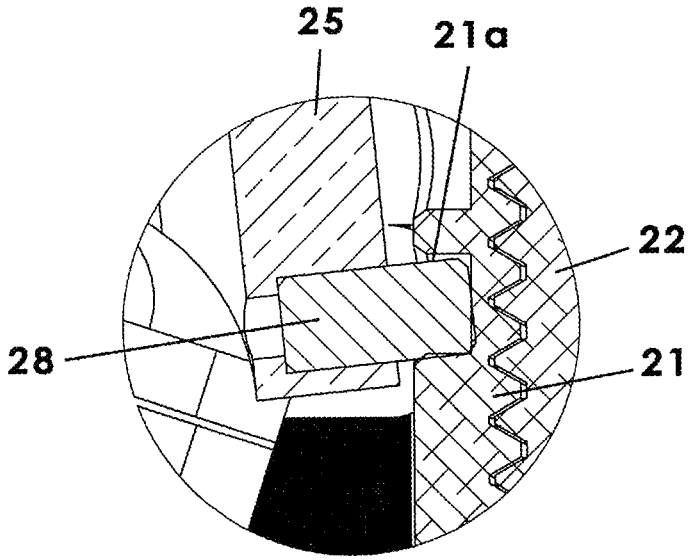
FIG. 6*d* is an isolated view on an enlarged scale taken from FIG. 6*c;*

Further, the pair of legs each includes an outer portion 34 having a tubular configuration defining an interior space, and an inner portion 36 slidably movable between a collapsed configuration substantially positioned in the interior space and an extended configuration extending away from the interior space. The outer portion 34 and inner portion 36 have a structure that enables selective length adjustment. More particularly, the inner portion 36 may define a plurality of extension adjustment apertures 36*a* and the outer portion 34 may include an extension locking rod 34*a* that is configured to selectively engage a selected adjustment aperture 36*a*, respectively. Further, each leg may include an extension release rocker 37*a* that is pivotally biased by an extension release rocker spring 37*b* (e.g., a compression spring) to normally bias a respective rod 34*a* to engage a respective aperture 36*a* and, thus, stop further longitudinal length adjustment of the inner and outer leg portions. As seen in FIG. 5*e*, the rod 34*a* and rocker spring 37*b* are opposite a pivot point of the release rocker 37*a* such that a user may compress the rocker spring 37*b* so as to release a current rod/aperture engagement such that the inner portion 36 may again be length adjusted relative to the outer portion 34. Still further, the forward leveling assembly 30 may include an anti-rotation fastener 39 that may be actuated (i.e., screwed in) so as to bear against the inner portion 36 and stop adjustment altogether (such as when a shooter has found his ideal adjustment). A base pad 26 may be coupled to a free end of the inner portion 36 for gripping a ground surface when deployed.

In still another aspect, the long barrel firearm 10 may include a support stick assembly for supporting and stabilizing the rifle at an elevated configuration. For instance, a hunter or target shooter may desire aiming and firing from a standing position and the support stick assembly bears the weight of the rifle with similar effectiveness and stability provided by the leveling assemblies described above. In an embodiment, the support stick assembly may include a mounting hole 41 defined by the front stock portion 19 and a support stick 40 selectively inserted into and secured in the mounting hole 41. Preferably, the support stick 40 has an elongate and linear configuration and is configured to have a dual use, namely, (1) to support the rifle in an elevated configuration displaced from a ground surface, and (2) to serve as a walking stick for a user while hiking. The support stick 40, therefore, is selectively and removably mounted to the front stock portion 19. More particularly, the support stick 40 may include a proximal end 42 having a tapered or pointed configuration for selective receipt into the mounting hole 41 and a distal end 43 having a durable construction intended for bearing against a ground surface. In an embodiment, the mounting hole 41 may include a threaded configuration. Further, the support stick 40 may include an attachment member 44 having a threaded surface that may be threadably coupled to the threaded mounting hole 41 and which also provides a desirable grip surface when used as a walking stick. In summary, therefore, the support stick 40 is selectively movable between a rifle support configuration coupled to and extending perpendicularly from the front stock portion 19 and a released configuration detached and displaced from the front stock portion 19.

In use, both leveling assemblies may be retracted to their respective storage configurations when the firearm is not in use (FIG. 1*a*) and then quickly deployed when the firearm 10 is to be used for target practice, hunting, or the like (FIG. 1*b*). Specifically, the monopod assembly 20 may first be spring actuated to extend downwardly and outwardly from the butt stock and then threadably length adjusted for fine tuning as described above. Similarly, the bipod assembly 30 may first be pivotally moved between its stored and use configurations and then spring-loaded for length adjustment. Accordingly, the present invention enables a firearm owner to have an integrated leveling and stabilizing system immediately available for use when shooting.

It is understood that while certain forms of this invention have been illustrated and described, it is not limited thereto except insofar as such limitations are included in the following claims and allowable functional equivalents thereof.

The invention claimed is:

1. A long barrel firearm, comprising:

a rifle support frame having a butt stock portion and front stock portion displaced from said butt stock portion, said butt stock portion defining a channel in communication with a deployment aperture and said front stock portion defining a pair of storage channels each having an open bottom;

a monopod assembly coupled to said butt stock portion and slidably movable in a first instance between a stowed configuration inside said channel and a deployed configuration substantially outside said channel, said monopod assembly including a spring positioned in said channel for normally biasing said monopod assembly from said stowed configuration to said deployed configuration when actuated;

a monopod activation assembly operably coupled to said spring for selectively actuating said spring to urge said monopod assembly toward said deployed configuration;

wherein said monopod assembly has a first portion fixedly attached to said spring and defining a chamber and has a second portion coupled to said first portion and movable in a second instance between a retracted configuration substantially inside said chamber and, when actuated, an extended configuration incrementally outside said chamber and extending away from said first portion;

a bipod assembly having a pair of legs pivotally coupled to said front stock portion and pivotally movable between a storage configuration nested in said pair of storage channels and a use configuration pivotally extending away from said pair of storage channels and splayed generally perpendicular to said front stock portion, each leg being length adjustable;

wherein said bipod assembly includes a pivot mechanism and a pair of centering springs that, when released, urge said pair of legs toward said use configuration;

a release mechanism operatively coupled to said front stock portion and configured to selectively release said pair of legs from said storage configuration;

wherein said pair of legs are each length adjustable and each includes (1) an outer portion having a tubular configuration defining an interior space and having an extension spring situated in said interior space, and (2) an inner portion normally biased by said extension spring to move slidably between a collapsed configuration positioned in said interior space and an extended configuration extending away from said interior space;

wherein said front stock portion defines a mounting hole adjacent said pair of storage channels;

a support stick having an elongate linear configuration and having a proximal end selectively received into said mounting hole and a distal end displaced from said proximal end, said support stick being selectively movable between a rifle support configuration coupled to and extending perpendicularly from said front stock portion and a released configuration detached from said front stock portion.

2. The long barrel firearm as in claim 1, wherein:

said first portion defines a plurality of extension position holes longitudinally spaced apart from one another;

said monopod activation assembly includes a pin operatively coupled to a monopod deployment button via a linkage, said pin being received in a respective extension position hole when actuated by said monopod deployment button and said linkage.

3. The long barrel firearm as in claim 2, wherein said second portion is threadably coupled to said first portion and rotatably movable between said retracted configuration substantially inside said chamber and said extended configuration incrementally outside said chamber and extending away from said first portion.

4. The long barrel firearm as in claim 1, wherein:

said pair of legs each includes a deployment switch having an adjustment rod and a link; and said inner portion defines a plurality of extension adjustment apertures longitudinally spaced apart from one another, said adjustment rod being received in a respective adjustment aperture when actuated by operation of said deployment switch and said link.

5. The long barrel firearm as in claim 4, wherein said link is a rocker switch coupled to said rod at one end and to said outer portion at an opposed end and having a pivot member situated therebetween such that said adjustment rod is moved in and out of engagement with said respective adjustment aperture by manipulation of said rocker switch.

6. The long barrel firearm as in claim 1, further comprising:

a base pad coupled to a free end of the second portion of the monopod assembly for gripping a ground surface when deployed; and another base pad coupled to a free end of the inner portion of each leg of said bipod assembly for gripping a ground surface when deployed.

7. The long barrel firearm as in claim 1, wherein:

said first portion of said monopod assembly includes an anti-rotation fastener that is threadably movable between a released configuration displaced from said second portion so as to permit rotation of said second portion and a stop configuration bearing against said second portion so as to prevent rotation of said second portion; and said outer portion of said bipod assembly each includes an anti-rotation fastener that is threadably movable between a released configuration displaced from said inner portion so as to permit movement of said inner portion and a stop configuration bearing against said inner portion so as to prevent movement of said inner portion.

8. A long barrel firearm, consisting of:

a rifle support frame having a butt stock portion and front stock portion displaced from said butt stock portion, said butt stock portion defining a channel in communication with a deployment aperture and said front stock portion defining a pair of storage channels each having an open bottom;

a monopod assembly coupled to said butt stock portion and slidably movable in a first action between a stowed configuration inside said channel and a deployed configuration substantially outside said channel, said monopod assembly including a spring positioned in said channel for normally biasing said monopod assembly from said stowed configuration to said deployed configuration when actuated;

a monopod activation assembly operably coupled to said spring for selectively actuating said spring to urge said monopod assembly toward said deployed configuration;

wherein said monopod assembly has a first portion fixedly attached to said spring and defining a chamber and has a second portion threadably coupled to said first portion and rotatably movable in a second action between a retracted configuration substantially inside said chamber and, when actuated, an extended configuration incrementally outside said chamber and extending away from said first portion;

a bipod assembly having a pair of legs pivotally coupled to said front stock portion and pivotally movable between a storage configuration nested in said pair of storage channels and a use configuration pivotally extending away from said pair of storage channels and splayed generally perpendicular to said front stock portion, each leg being length adjustable;

wherein said bipod assembly includes a pivot mechanism and a pair of centering springs that, when released, urge said pair of legs toward said use configuration;

a release mechanism operatively coupled to said front stock portion and configured to selectively release said pair of legs from said storage configuration;

wherein said pair of legs are each length adjustable and each includes (1) an outer portion having a tubular configuration defining an interior space and having an extension spring situated in said interior space, and (2) an inner portion normally biased by said extension spring to move slidably between a collapsed configuration positioned in said interior space and an extended configuration extending away from said interior space;

wherein said front stock portion defines a mounting hole adjacent said pair of storage channels;

a support stick having an elongate linear configuration and having a proximal end selectively received into said mounting hole and a distal end displaced from said proximal end, said support stick being selectively movable between a rifle support configuration coupled to and extending perpendicularly from said front stock portion and a released configuration detached from said front stock portion;

wherein said support stick includes a fastener adjacent said proximal end configured to threadably couple said support stick to said mounting hole and in said rifle support configuration.

9. The long barrel firearm as in claim 8, wherein:

said first portion defines a plurality of extension position holes longitudinally spaced apart from one another;

said monopod activation assembly includes a pin operatively coupled to a monopod deployment button via a linkage, said pin being received in a respective extension position hole when actuated by said monopod deployment button and said linkage.

10. The long barrel firearm as in claim 8, wherein:

said pair of legs each includes a deployment switch having an adjustment rod and a link; and said inner portion defines a plurality of extension adjustment apertures longitudinally spaced apart from one another, said adjustment rod being received in a respective adjustment aperture when actuated by operation of said deployment switch and said link.

11. The long barrel firearm as in claim 8, wherein said link is a rocker switch coupled to said rod at one end and to said outer portion at an opposed end and having a pivot member situated therebetween such that said adjustment rod is moved in and out of engagement with said respective adjustment aperture by manipulation of said rocker switch.

* * * * *